US006000809A

United States Patent [19]

Belo

[11] Patent Number: 6,000,809

[45] Date of Patent: Dec. 14, 1999

[54] ADJUSTABLE, SELF-ILLUMINATING, WRITING INSTRUMENT

[76] Inventor: Michele Belo, 34150 Ada Dr., Solon, Ohio 44139

[21] Appl. No.: 08/978,710

[22] Filed: Nov. 26, 1997

[51] Int. Cl.[6] ..... B43K 29/10

[52] U.S. Cl. ..... 362/118; 362/198

[58] Field of Search ..... 362/118, 109, 362/157, 189, 198, 202, 253; D26/43

[56] References Cited

U.S. PATENT DOCUMENTS

| | | | |
|---|---|---|---|
| D. 329,823 | 9/1992 | Francisco | D10/104 |
| D. 376,217 | 12/1996 | Kaiser | D26/43 |
| D. 377,989 | 2/1997 | Marvin | D26/43 |
| 1,169,029 | 1/1916 | Gunnerson | 362/118 |
| 4,047,017 | 9/1977 | Herring | 362/118 |
| 4,518,274 | 5/1985 | Hanggi | 401/195 |
| 4,737,894 | 4/1988 | Kuch et al. | 362/118 |
| 4,890,204 | 12/1989 | Lin et al. | 362/118 |
| 5,131,775 | 7/1992 | Chen | 401/195 |
| 5,193,897 | 3/1993 | Halsey | 362/118 |
| 5,385,500 | 1/1995 | Schmidt | 446/73 |
| 5,400,227 | 3/1995 | Maglica | 362/206 |

*Primary Examiner*—Thomas M. Sember
*Assistant Examiner*—Marshall Honeyman

[57] ABSTRACT

An adjustable, self-illuminating, writing instrument is provided having a main shaft terminating at one end in a pen and at the other end with a flexible shaft supporting a directable illumination source. An on/off switch is provided which also serves as a diameter adjustment mechanism for the beam created by the illumination source.

9 Claims, 4 Drawing Sheets

ADJUSTABLE, SELF-ILLUMINATING, WRITING INSTRUMENT

BACKGROUND OF THE INVENTION

1. Field of the Invention

The present invention relates generally to self-illuminating writing devices, and, more particularly, to an adjustable, self-illuminating, writing instrument.

2. Description of the Related Art

As is well known, it is difficult for individuals to write on paper when there is insufficient light present. However, there are many situations where this type of writing is required. For example, students must take notes during movie and slide presentations, where illumination is low. Some occupations require the completion of log books and forms in the dark, or in dark vehicles. These can include truck drivers, cab drivers, delivery persons, insurance adjusters and appraisers, and law enforcement personnel. Other jobs (for example food servers) often require writing in dimly lit conditions. Doctors and nurses must write important medical information on patients' room charts without turning on the lights and disturbing them. Travelers in automobiles, buses, trains and airplanes at night also face this situation.

Conventional writing instruments do not offer illumination of the paper being written on. Using bulky pen lights in conjunction with conventional writing instruments is awkward and difficult. As a result, the need for an improved and maneuverable self-illuminated writing instrument exists.

Early devices provided for an illumination device which was external to the writing instrument. These devices, such as U.S. Pat. No. 1,345,962, issued in the name of Sanders, consisted of a small flashlight type device which clamped to the body of a writing instrument. Such devices, however, were bulky and weighted one side of the writing device, making the devices not ergonomic and uncomfortable to use.

Later devices disclosed the source of illumination internal to the writing instrument. Examples of these devices are U.S. Pat. No. 4,737,894, issued in the name of Kuch et al., and U.S. Pat. No. 4,518,274, issued in the name of Hanggi. These devices, however, are bulky, and provide for uneven illumination.

Other problems are prevalent throughout the previous art. First, the devices illuminate a fixed area around the writing instrument, and can be adjusted only by moving the position of the device relative to the paper. Second, the light emitted from devices of the previous is diffuse and uneven. Third, there is no adjustability of the diameter of the light beam.

These problems arise in various circumstances. First, when it is necessary to see multiple areas of a page simultaneously, such as when data or information is being copied. The previous devices necessitate that the user move the lighted instrument back and forth between parts of the page to transfer the information. This can be annoying, disorienting, and lead to errors during copying. One attempt to deal with this problem is disclosed in U.S. Design Pat. No. 329,823, issued in the name of Francisco. A light bulb is disclosed, mounted on the far end of the writing instrument, with respect to the paper. Such an arrangement, however, does not provide sufficient illumination. The light is diffused in a 360-degree orientation, and is not strong enough to illuminate more than a small surface area. Also, there is no way to focus the light in any particular direction, such as to focus on a particular segment of a paper.

Attempts to provide for coverage of larger surface area include devices such as that disclosed in U.S. Pat. No. 4,890,204, issued in the name of Lin et al. This device discloses a lamp, lamp reflector and a light reflecting sleeve, such that the light travels through the body of the pen holder. However, such illumination is nonadjustable in direction, uneven, and too diffuse to adequately illuminate a large segment of the page. Also, such devices do not provide the type of room light people are accustomed to using. Instead, these devices create a type of glowing light that can be disorienting.

Another circumstance which the related art fails to address is the situation where the writing instrument is not used perpendicular to the paper being written on, such as when writing on a vertically oriented page, or writing on paper in the person's lap. In these situations, the previous art fails to provide for movement of the focal point of the illuminating device to a direction that facilitates easier writing without changing the orientation of the writing instrument itself.

Another common instance that the previous art fails to adequately address is the one in which the user desires to adjust the diameter of the light beam being emitted, such as when a passenger in a vehicle wishes to utilize a light but not cause a glare that can disturb a driver.

Other attempts to address these illumination problems, such as U.S. Pat. No. 5,131,775, issued in the name of Chen, utilize complex electronic circuitry, which makes the devices difficult to manufacture and expensive. Also, these types of devices have only an unidirectional orientation, and do not allow for the adjustment of light beam diameter.

Tangentially relevant to the present invention are the combination pen and light pointer devices, such as U.S. Pat. No. 5,193,897, issued in the name of Halsey. These devices, however, are not designed for the purpose of illuminating the paper being written on. In fact, the illuminating and writing components of these devices do not function simultaneously. These devices are designed for convenience, with two separate components stored in one device. These devices allow the user to point to items on wall charts and the like, and at a later time, also use the writing device. As such, they do not fulfill the function of the present invention. Consequently, a need has been felt for providing an apparatus and method which overcomes the problems cited above.

SUMMARY OF THE INVENTION

It is therefore objects of the present invention to provide an improved self-illuminating, writing instrument that is compact, ergonomic, comfortable, inexpensive, allows for manual multi-directional orientation of an even, non-diffuse light beam, provides sufficient illumination of a large surface area of the paper, and allows for adjustment of the diameter of the light being emitted.

The present invention has numerous potential embodiments. In a preferred embodiment, the present invention consists of a hollow, elongated shaft. This main shaft is composed of a durable, long lasting material such as metal or plastic. The main shaft terminates on one end with a writing means. The writing means extends inside the main shaft, and runs parallel with the main shaft. Also, positioned inside the main shaft, next to the writing means is at least one battery. Affixed to the end of the main shaft, opposite the writing means, is an elongated, flexible shaft. This flexible shaft extends vertically from the main shaft. The flexible shaft is extendible, allowing it to be positioned in either the retracted or elongated positions. The flexible shaft is hollow, and is composed of a durable, long lasting material, such as plastic. Affixed to the end of the flexible shaft, opposite the main shaft, is an illumination means.

In an alternate embodiment, the flexible shaft is replaced by a jointed hinge with a swivel feature, which provides the position adjustment capabilities. Other embodiments disclose the flexible shaft and the jointed hinge with swivel as separate attachments that would attach to existing non-illuminating writing instruments, and provide a multi-directional illuminated means.

In the preferred embodiment, the flexible shaft can be manually manipulated to position the illumination means in numerous directions. The flexible shaft can be simply angled onto the surface of the paper, or for added support, can be extended on or around the main shaft with the illumination means angled toward the writing surface.

Running inside the flexible shaft, and connecting the battery to the illumination means is an electrical connection means such as an electrical conductor. Sufficient wiring is provided to facilitate connection between the battery and the illumination means both while the flexible shaft is in the retracted or extended positions.

Connected to the housing of the illumination means is a twist mechanism that turns the present invention on and off. The on/off switch also serves as a diameter adjustment means for the beam created by the illumination means. As the switch is turned, the beam varies in diameter.

A feature of the present invention is that it facilitates the simultaneous use of a writing instrument and an illuminating element, thus making it possible for individuals to successfully and legibly write in dimly lit or dark areas. By providing sufficient light, the present invention also reduces eye strain and disorientation while writing.

Another feature of the present invention is the position of the light emitting device. The bulb is positioned on the end of the writing instrument, which creates several benefits. First, the majority of the light emitted from the illumination means does not pass through the body cavity, and therefore, the light is not diffused, but a clear, intense beam of light. Second, the distance between the end of the writing instrument and the paper facilitates the light illuminating a larger area of paper. Seeing the majority of a page requires less concentration and focus then following the light from word to word. Thus, fatigue, eye soreness, and general discomfort is reduced.

Another feature of the present invention is the flexible shaft. This feature allows the user to manually adjust the direction of the light beam emitted without having to alter the position of the writing instrument relative to the paper. This creates the benefit of the user being able to choose other areas of the page he or she wishes to view. This facilitates the easy copying of information from one part of a page to another, and writing on paper that is positioned at unnatural, non-optimal angles relative to the writing instrument, such as a person writing on paper that is positioned in his or her lap.

Another feature of the present invention is the twist diameter adjustment mechanism. This feature allows the user to alter the diameter of the light emitted, which is helpful in situations such as writing in bed with a sleeping partner.

Another feature of the present invention is that it can be used as a flashlight by keeping the flexible shaft in the retracted position and simply twisting on the switch mechanism attached to the illumination means.

Another feature of the present invention is that it provides even illumination.

Another feature of the present invention is its streamline, ergonomic design. Thus, the present invention is comfortable to use and reduces hand cramping.

Another feature of the present invention is that it is simple in design, which reduces manufacturing costs.

Another feature of the present invention is that it is inexpensive to produce.

Another feature of the present invention in an alternate embodiment is the flexible shaft that attaches to existing writing instruments. This embodiment provides illumination capabilities to otherwise non-illuminating writing instruments. This embodiment is streamline and does not create an uneven weight distribution when used with a traditional writing instrument.

It is further envisioned in alternate embodiments that the present invention will disclose various sizes, in terms of length and diameter. Shorter versions may be used for key chains and the like. Also, a waterproof model is envisioned, as well as an embodiment that would enable the device to write upside down. An opaque casing is envisioned to provide additional light emitted through the body of the device. Also, opaque colored housings are envisioned that will change the color of the light being transmitted through the housing. A clear main shaft is also envisioned.

It is further envisioned in alternate embodiments that a clip will be attached to the housing of the present invention, facilitating storage of the device in pockets and folders.

It is further envisioned in alternate embodiments that animation will be placed on the top of the device, above and below the flexible shaft, with the flexible shaft acting as the body of the character.

Variations of the light size and design are also envisioned in alternate embodiments, such as an illumination means consisting of a slightly rounded, bubble-type bulb.

It is further envisioned in alternate embodiments that the present invention will disclose main shafts constructed of various materials, such as plastic, aluminum, ceramic, metal, and others. A softer feel is envisioned by utilizing smooth plastics.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
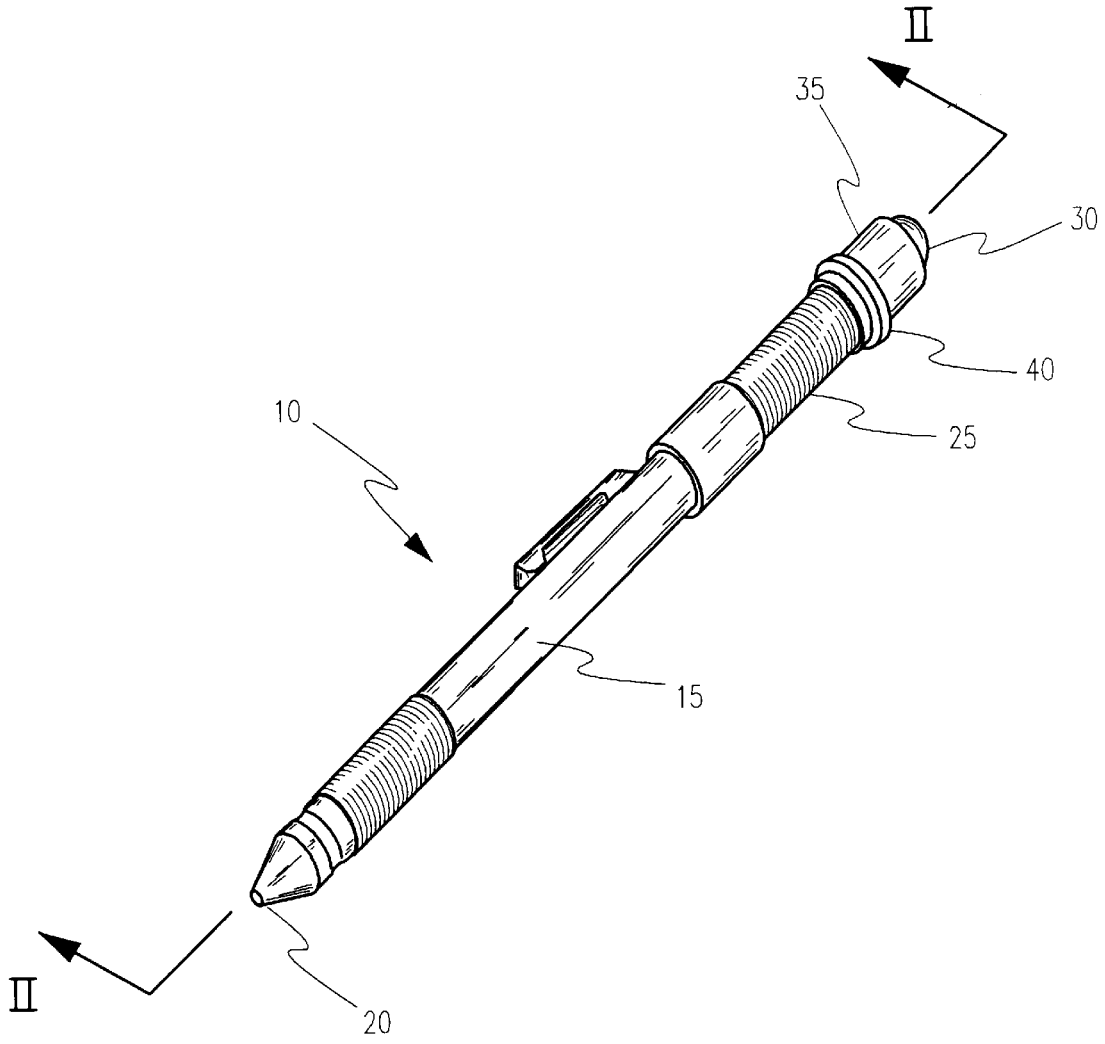
FIG. 1 is a side elevational view of the preferred embodiment of the present invention with the flexible shaft in the retracted position.

Referring now to FIG. 1, an adjustable, self-illuminating, writing instrument, generally denoted as 10 is depicted, according to the preferred embodiment of the present invention, having a main shaft 15, a writing means 20, a flexible shaft 25, an illumination means 30, an illumination means housing 35 and a twist on/off and beam diameter adjustment mechanism 40.

The main shaft 15 is an elongated, hollow shaft composed of a durable, long lasting material such as metal or plastic. The main shaft 15 terminates on one end with the writing means 20. Affixed to the end of the main shaft 15, opposite the writing means 20, is the flexible shaft 25. The flexible shaft 25 is an elongated flexible shaft connected vertically to the main shaft 15. The flexible shaft 25 is extendible, allowing it to be positioned in either the retracted or elongated positions. The flexible shaft 25 is hollow, and is composed of a durable, long lasting material, such as plastic. Affixed to the end of the flexible shaft 25 opposite the main shaft 15 is the illumination means 30. The illumination means 30 is connected to the end of the flexible shaft 25 by an illumination means housing 35. Connected to the illumination means housing 35 is a twist on/off beam diameter adjustment mechanism 40, which turns the present invention on and off. It also serves as a diameter adjustment means for the beam created by the illumination means 30.

Figure 2:
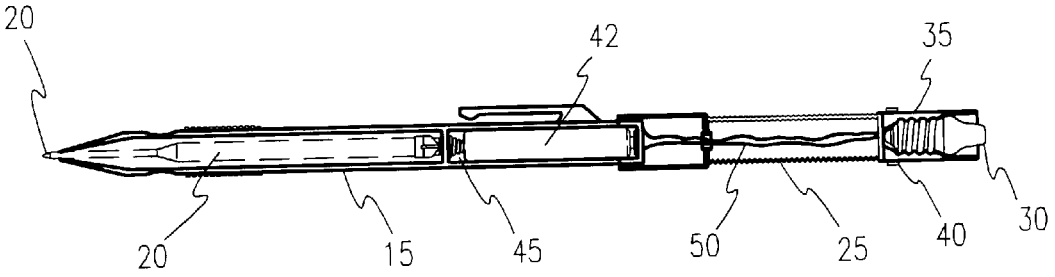
FIG. 2 is a side cross sectional view of the preferred embodiment shown in FIG. 1 taken along lines II—II.

Referring now to FIG. 2, the writing means 20 extends inside the main shaft 15, which is hollow. The writing means 20 runs parallel to the main shaft 15. Also, positioned inside the main shaft 15, next to the writing means 20, and parallel to the main shaft 15, is at least one battery 42. The battery 42 is housed in a battery supporting cavity 45, which is conventional in nature and located within the main shaft 15.

Figure 3:
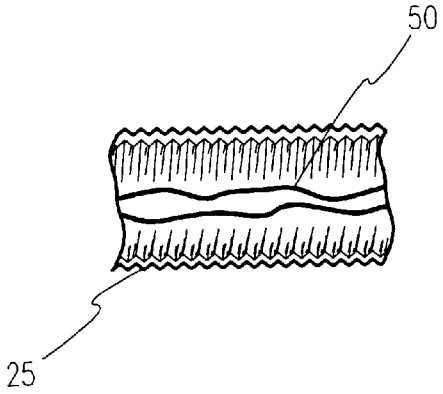
FIG. 3 is an enlarged cross sectional view of the flexible shaft shown in FIG. 1 taken along lines II—II.

Referring now to FIG. 2 and FIG.3, the electrical communication means, herein depicted as electrically conductive wire 50, runs inside the main shaft 15 and the flexible shaft 25, both of which are hollow. The wire 50 connects the battery 42 and the illumination means 30. Sufficient wire 50 is provided to facilitate connection between at least one battery 42 and the illumination means 30 while the flexible shaft 25 is in either the retracted or extended positions.

FIG. 3 shows in more detail the external structure of the flexible shaft 25. The exterior of the flexible shaft 25 is comprised of numerous ribbed segments in fluid contact with each other. Each ribbed section can be extended or retracted, and as a group, they provide a means for extension and retraction of the entire flexible shaft 25. The ribbed sections also provide the flexibility that enables the flexible shaft 25 to be wrapped around the main shaft 15 during use, if desired.

Figure 4:
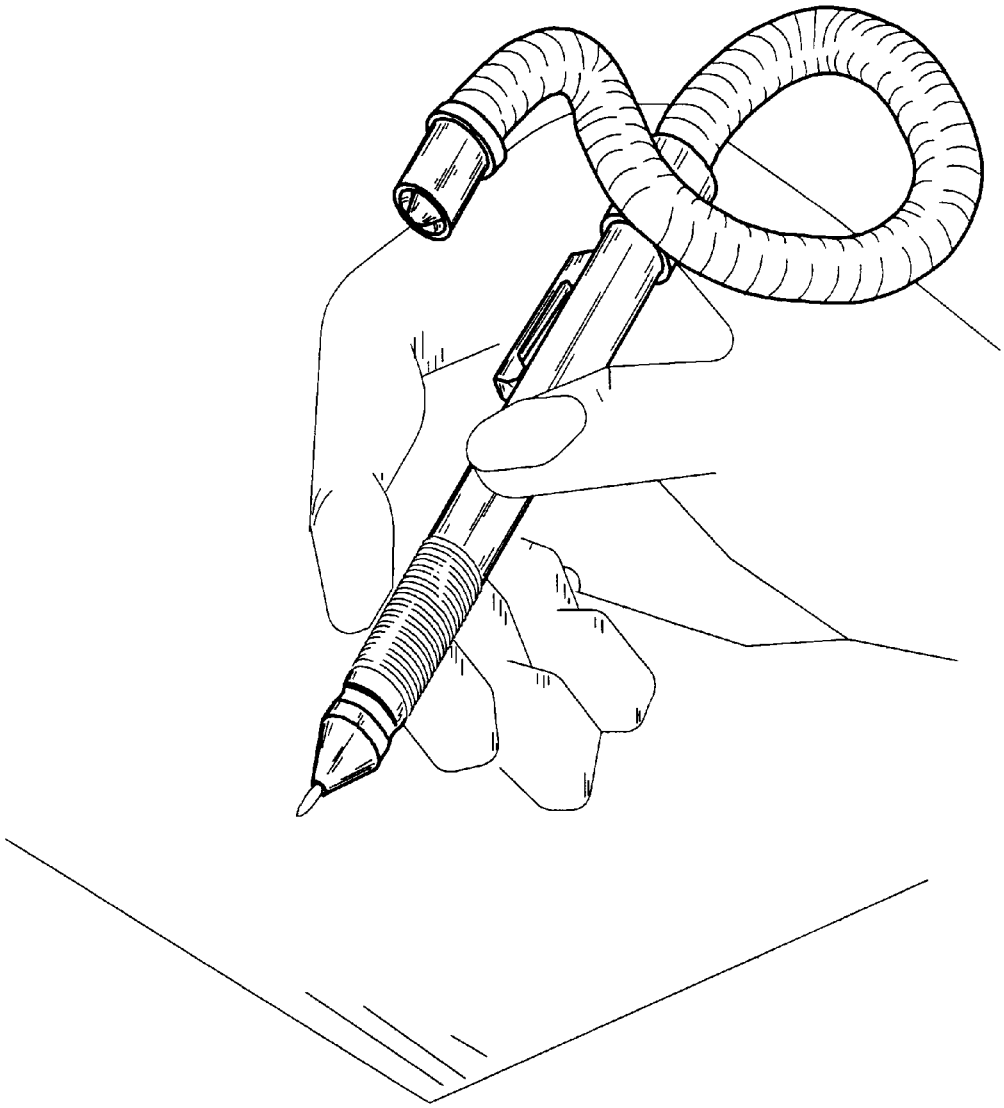
FIG. 4 is an in-use view of the preferred embodiment.

FIG. 4 shows the preferred embodiment of the present invention in use with the flexible shaft 25 in the extended position wrapped around the main shaft 15.

Figure 5:
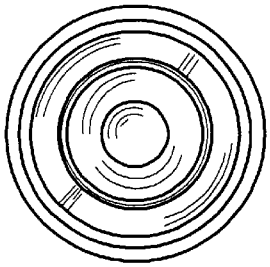
FIG. 5 is an end view of the preferred embodiment.

Referring to FIG. 5, an end view of the present invention is depicted in order to show the slim-line and ergonomic nature of the present invention.

Figure 6:
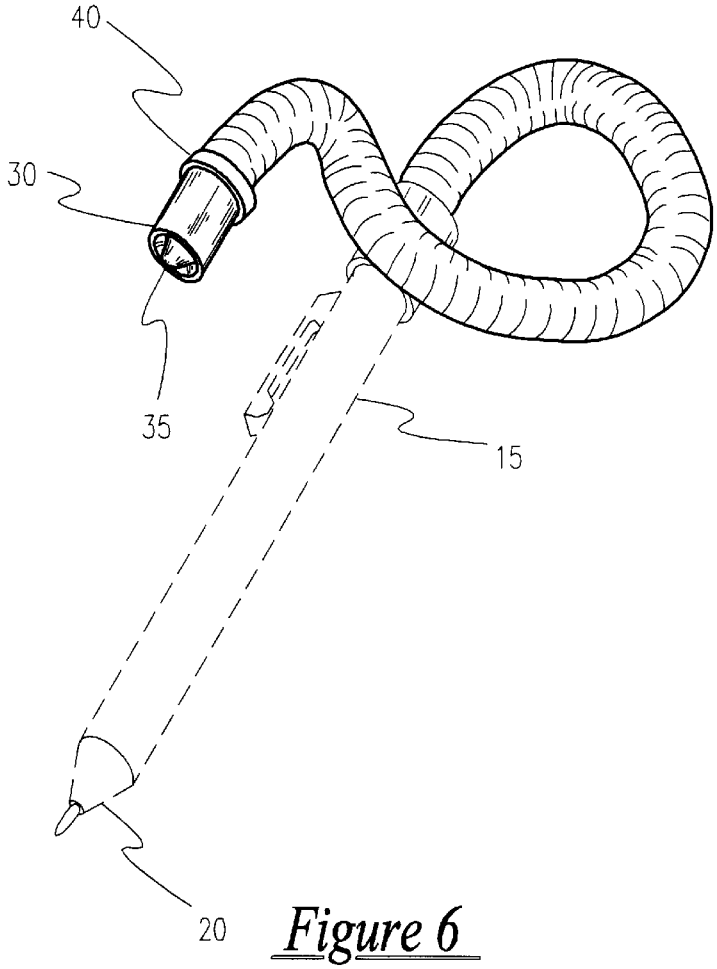
FIG. 6 is a side elevational view of an alternate embodiment.

Referring now to FIG. 6, an alternate embodiment of the present invention is disclosed. The flexible shaft 25 illustrated in FIGS. 1–4 is formed as a separable component to provide the articulation capabilities of the present invention in a manner attachable to a separate, conventional writing implement.

2. Operation of the Preferred Embodiment

To use the present invention, the user activates the illumination means 30 by turning the twist on/off and beam diameter adjustment mechanism 40 until illumination occurs. The user then continues the twisting action until the desired illumination beam diameter is achieved. The flexible shaft 25 is then manually manipulated to position the illumination means 30 in the desired direction. The flexible shaft 25 can be simply angled onto the surface of the paper to be read, or for added support, can be extended on or around the main shaft 15 with the illumination means 30 angled toward the writing surface.

The foregoing description is included to illustrate the operation of the preferred embodiment and is not meant to limit the scope of the invention. The scope of the invention is to be limited only by the following claims.

What is claimed is:

1. An adjustable, self-illuminating, writing instrument comprising:

a main shaft having a first end and a second end;

writing means affixed to said main shaft at said first end;

a flexible shaft affixed to said main shaft at said second end, wherein said flexible shaft is an elongated flexible shaft connected vertically to the main shaft, and further where said flexible shaft is extendible, allowing it to be positioned in either the retracted or elongated positions, an illumination means for illuminating a writing surface at a point where said writing means contacts a writing surface;

an illumination means housing for housing said illumination means, said illumination means housing supported on said flexible shaft opposite said flexible shafts connecting to said main shaft; and electrical communication means for connecting at least one battery to said illumination means.

2. The writing instrument of claim 1, wherein said flexible shaft is comprised of numerous ribbed segments in fluid contact with each other such that each ribbed section can be extended or retracted, and as a group, they provide a means for extension and retraction of the entire flexible shaft.

3. The writing instrument of claim 2, wherein said ribbed sections also provide sufficient flexibility such that said flexible shaft can be wrapped around the main shaft during use.

4. The writing instrument of claim 1, wherein said flexible shaft comprises:

a jointed hinge; and a swivel such as to provide articulation capabilities of the said illumination means;

and wherein both said jointed hinge and said swivel are hollow to allow a wire to pass through from a battery to the illumination means.

5. The writing instrument of claim 1, wherein said flexible shaft is composed of a durable, long lasting material.

6. The writing instrument of claim 1, further comprising a twist on/off beam diameter adjustment mechanism connected to the illumination means housing for activating or deactivating the illumination means.

7. The writing instrument of claim 6, wherein said adjustment mechanism further functions as a diameter adjustment means for the beam created by said illumination means.

8. The writing instrument of claim 1, wherein said writing means extends inside said hollow main shaft.

9. The writing instrument of claim 8, further comprising a battery supporting cavity located within said main shaft.

* * * * *